US006595521B2

(12) United States Patent
Uedono et al.

(10) Patent No.: US 6,595,521 B2
(45) Date of Patent: Jul. 22, 2003

(54) GAME MACHINE WITH CLAWS

(75) Inventors: Yoshikazu Uedono, Kiryu (JP); Akira Hanazuka, Kiryu (JP); Takashi Takatsuki, Kiryu (JP)

(73) Assignee: Japan Servo Co., Ltd., Tokyo (JP)

( * ) Notice: Subject to any disclaimer, the term of this patent is extended or adjusted under 35 U.S.C. 154(b) by 0 days.

(21) Appl. No.: 10/192,548

(22) Filed: Jul. 11, 2002

(65) Prior Publication Data

US 2003/0011133 A1 Jan. 16, 2003

(30) Foreign Application Priority Data

Jul. 12, 2001 (JP) ..... 2001-211923

(51) Int. Cl.[7] ..... A63F 9/00
(52) U.S. Cl. ..... 273/448
(58) Field of Search ..... 273/440, 447, 273/448

(56) References Cited

U.S. PATENT DOCUMENTS 6,062,567 A * 5/2000 Uetono et al. ..... 273/447
6,311,981 B1 * 11/2001 Uetono et al. ..... 273/447
2003/0011133 A1 * 1/2003 Uedono et al. ..... 273/447

FOREIGN PATENT DOCUMENTS

JP 10-295929 * 11/1998 ..... A63F/9/00
JP 2001-157772 * 6/2001 ..... A63F/9/30
JP 2002-239209 * 8/2002 ..... A63F/9/30

* cited by examiner

*Primary Examiner*—Raleigh W. Chiu
(74) *Attorney, Agent, or Firm*—Birch, Stewart, Kolasch & Birch, LLP

(57) ABSTRACT

A game machine according to the present invention includes claws for holding a thing. The machine also includes an acquisition detector, a closing pivotal angle controller, a continuous play controller and a playable game computer. If a player has acquired nothing from the game machine in the last game, and the detector outputs an acquisition failure signal, the angle controller increases the closing pivotal angle of the claws. If the player has acquired a thing from the machine in the last game, and the detector outputs an acquisition success signal, the angle controller decreases the pivotal angle. If the play controller outputs a continuous play signal, the game computer increases the number of playable games.

15 Claims, 10 Drawing Sheets

GAME MACHINE WITH CLAWS

BACKGROUND OF THE INVENTION

1. Field of the Invention

The present invention relates to a game machine having claws for holding a thing.

2. Description of the Prior Art

A conventional game machine of this type includes two moving members, one of the moving members supports one end of a telescopic rod. The telescopic rod carries claws on its other end. When a player pushes operating buttons of the game machine, the moving members move, and the rod extends by a predetermined length. Then, the claws pivot to their closed position. With the claws closed, the rod retracts to its home position. Then, the moving members move to position the claws over the drop area in the machine. Then, the claws pivot to their open position, and the moving members move to return the open claws to their home position. If the closed claws over the drop area hold a thing, the thing drops onto this area when they open. A conveyor conveys the thing from the drop area to the outlet port of the machine, out of which the player can take the thing.

Whether the player has acquired the thing or nothing from the game machine, the claws pivot by a constant angle to their closed positions.

SUMMARY OF THE INVENTION

The object of the present invention is to provide a game machine having claws that can close by pivoting by a different angle depending on whether a player has acquired a thing or nothing from the machine.

The present invention provides a game machine comprising a main body, a first moving member supported movably by the body, an operating button for operating the first moving member, pivotable claws carried by the first moving member, an acquisition detecting means for detecting a thing acquired in the last game, and a closing pivotal angle controlling means for controlling the closing pivotal angle of the claws in accordance with the output from the acquisition detecting means.

In this game machine, the closing pivotal angle of the pivotable claws depends on whether a player has acquired a thing or nothing in the last game.

Other and further objects, features and advantages of the invention will appear more fully from the following description.

DETAILED DESCRIPTION OF THE INVENTION

Figure 1:
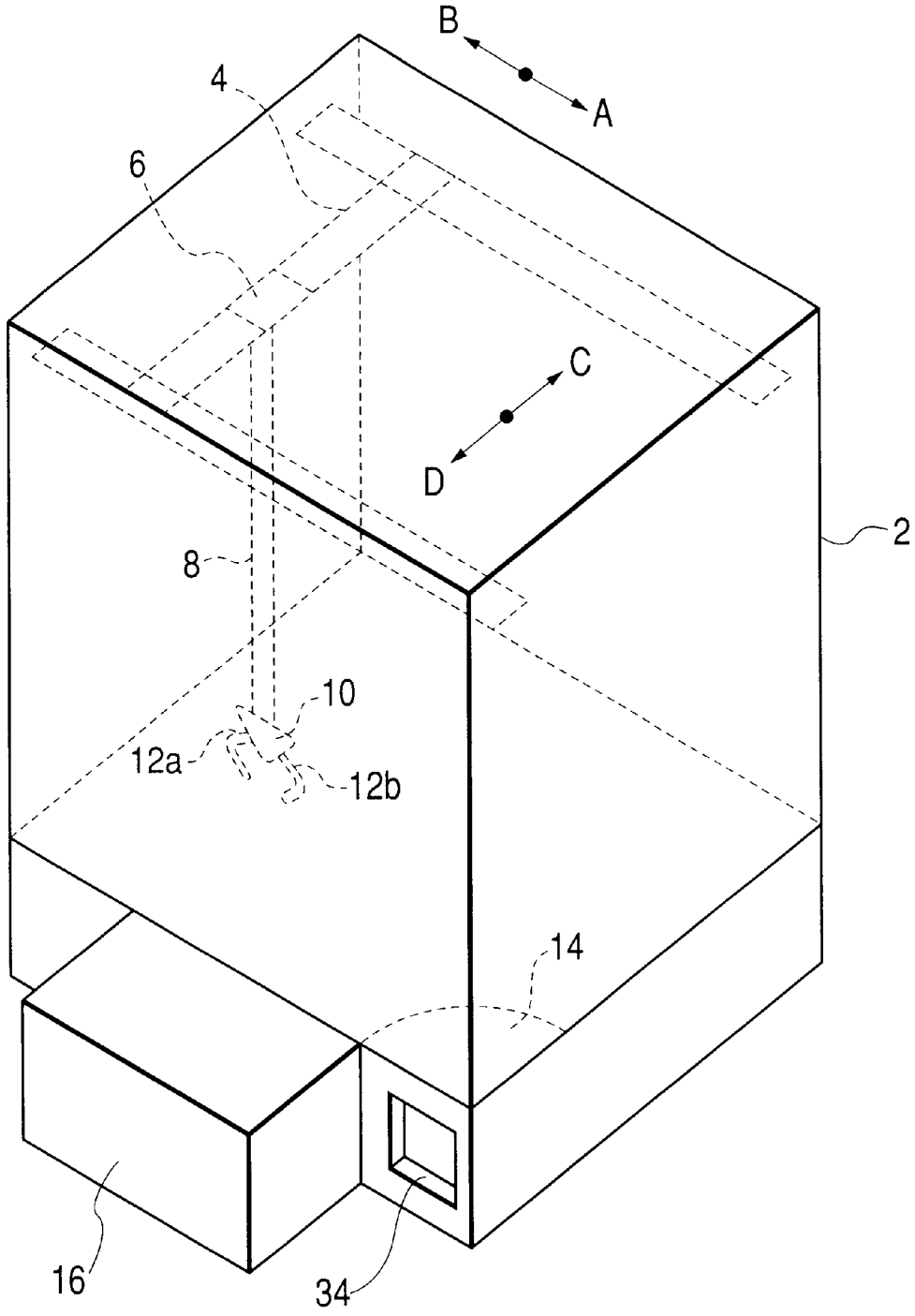
FIG. 1 is a schematic perspective view of a game machine embodying the present invention.
Figure 2:
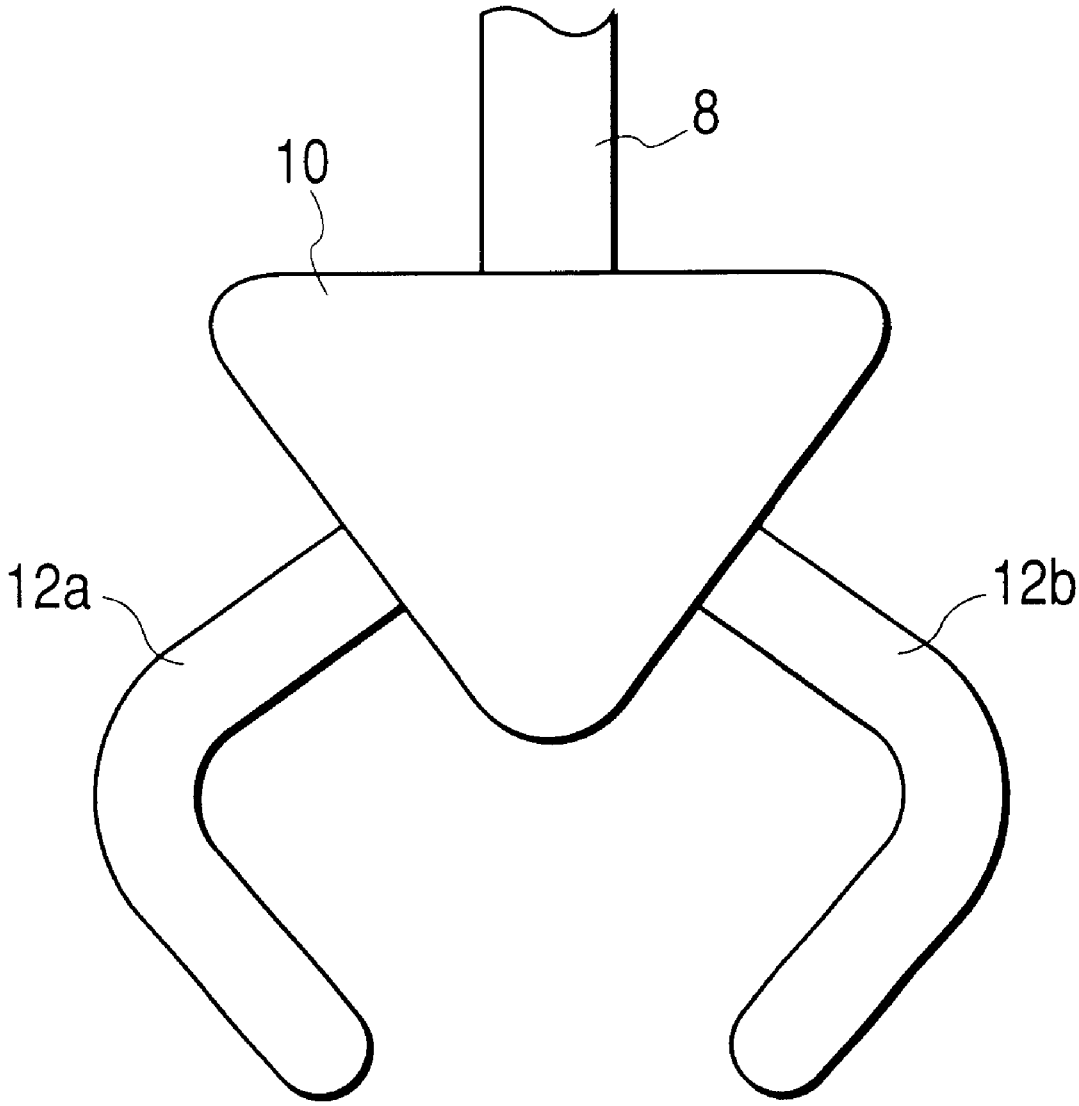
FIG. 2 is a front view of part of the telescopic rod, the holder body, and the claws of the game machine shown in FIG. 1.
Figure 3:
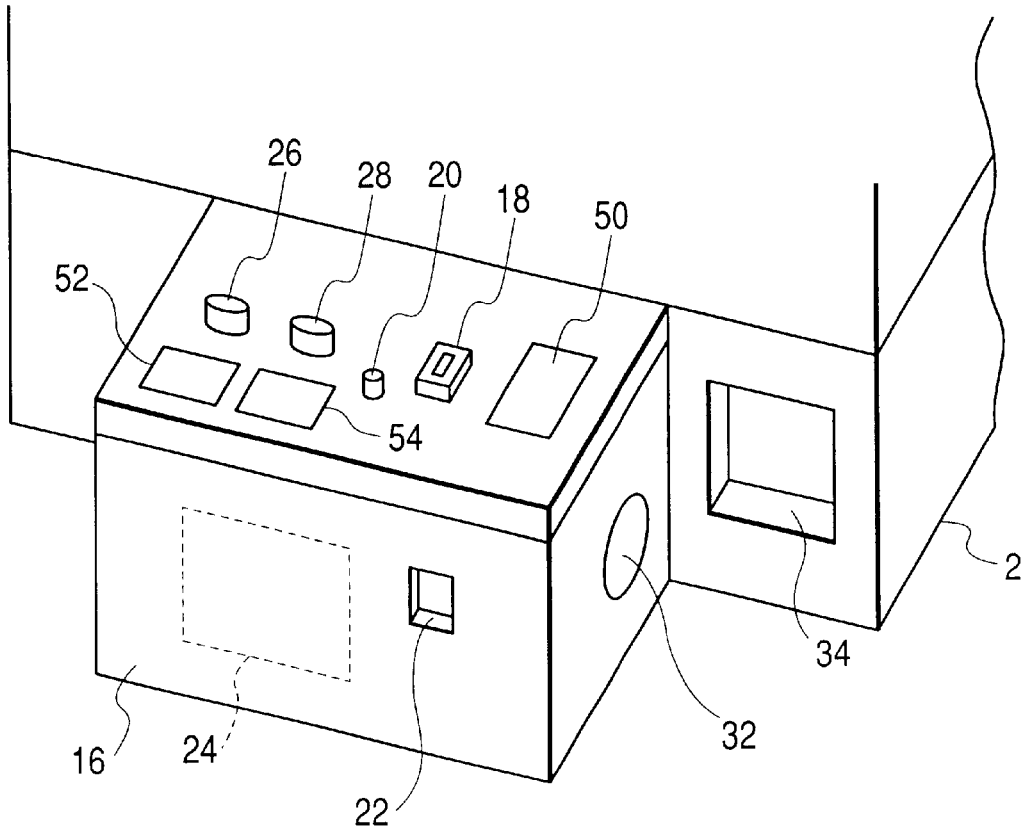
FIG. 3 is a perspective view of the console and part of the game machine shown in FIG. 1.
Figure 4:
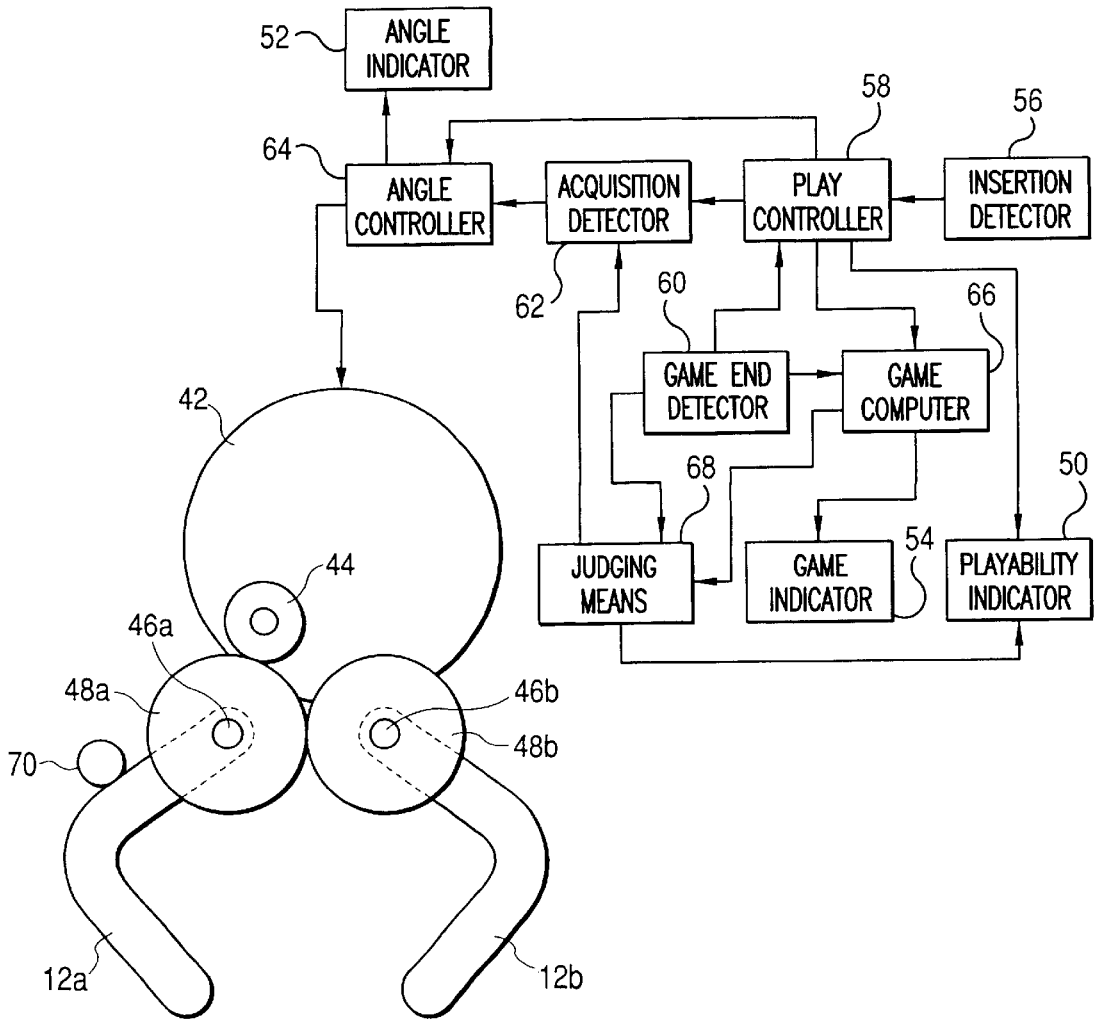
FIG. 4 is a block diagram of the controller of the game machine shown in FIG. 1.
Figure 5:
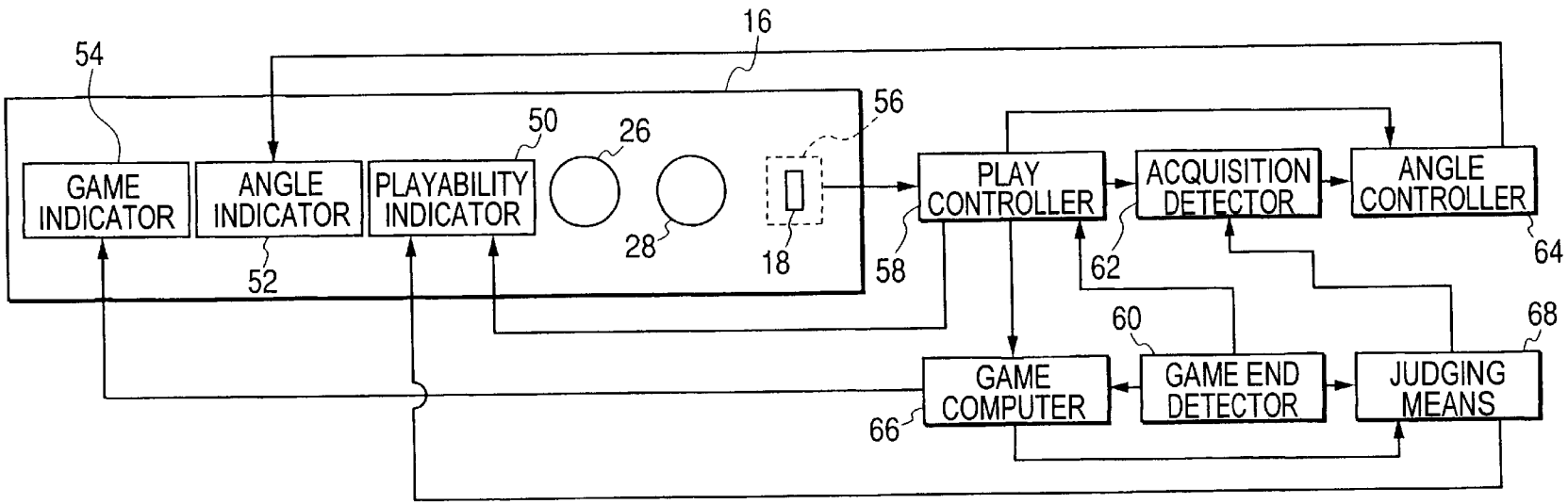
FIG. 5 is another block diagram of the controller of the game machine shown in FIG. 1.

With reference to FIGS. 1–5, a game machine embodying the present invention includes a main body 2. A right-and-left moving member 4 is supported by the body 2 movably in horizontal direction A–B (FIG. 1). A back-and-forth moving member 6 is supported by the moving member 4 movably in horizontal direction C–D (FIG. 1). The back-and-forth moving member 6 carries a telescopic rod 8, which carries a holder body 10 on its free end. A pair of claws 12*a* and 12*b* is supported pivotably by the holder body 10. The game machine also includes drives (not shown) each for driving one of the moving members 4 and 6, the telescopic rod 8, and the holder body 10. The body 2 includes a drop corner 14 formed at its bottom and an outlet port 34 opening into the corner 14. The game machine further includes a console 16 fitted outside the body 2. The console 16 has a coin slot 18, a coin return button 20, a coin return port 22, a cashbox 24, a right-and-left operating button 26, a back-and-forth operating button 28 and a speaker 32. The game machine further includes controlling means for controlling the drives for the right-and-left moving member 4 etc. in accordance with the operation of the console 16. A number of stuffed toys or other things (not shown) are put on the portion other than the drop corner 14 of the bottom of the body 2.

The holder body 10 is fitted with a synchronous motor 42. The turning quantity of the output shaft of the motor 42 can be controlled. A gear 44 is fixed to this output shaft. A pair of rotating shafts 46*a* and 46*b* is supported rotatably by the holder body 10. The claws 12*a* and 12*b* are fixed to the rotating shafts 46*a* and 46*b* respectively, to which a pair of gears 48*a* and 48*b* is fixed respectively. The gear 44 meshes with the gear 48*a*, which meshes with the gear 48*b*. The holder body 10 is also fitted with an open claw detecting means 70 for detecting the opening of the claws 12*a* and 12*b*.

The console 16 has a continuous playability indicating means 50, a closing pivotal angle indicating means 52 and a playable game indicating means 54. The playability indicating means 50 visually indicates whether a player can keep a continuous play with the game machine. The angle indicating means 52 visually indicates the closing pivotal angle of the claws 12*a* and 12*b*. The game indicating means 54 visually indicates how many games can be played.

The game machine includes a coin insertion detecting means 56 for outputting a coin insertion signal when it detects the insertion of a coin in the coin slot 18. The insertion detecting means 56 is connected to a continuous play controlling means 58, which is connected to a game end detecting means 60 for outputting an end-of-game signal when it detects the end of a game, for example, the return of the claws 12*a* and 12*b* to their home positions. The play controlling means 58 is also connected to the continuous playability indicating means 50 and an acquisition detecting means 62 for detecting the acquisition of a held thing. The play controlling means 58 and the acquisition detecting means 62 are connected to a closing pivotal angle controlling means 64 for controlling the turning angle of the output shaft of the synchronous motor 42 to control the closing pivotal angle of the claws 12*a* and 12*b*. Specifically, the angle controlling means 64 causes the motor 42 to be driven selectively for 3, 3.5, 4, 4.5 or 5 seconds. This controls the turning angle of the output shaft of the motor 42 in such a manner that the closing pivotal angle of the claws 12*a* and 12*b* may selectively be a first, a second, a third, a fourth or a fifth angle. The angle controlling means 64 is connected to the angle indicating means 52. The play controlling means 58 and the game end detecting means 60 are connected to a playable game computing means 66 for computing the number of playable games. The game computing means 66 is connected to the playable game indicating means 54 and a continuous game end judging means 68 for judging whether a continuous game has ended. This judging means 68 is connected to the game end detecting means 60, the acquisition detecting means 62 and the playability indicating means 50.

If the insertion detecting means 56 outputs the coin insertion signal after 9 seconds from the time when the game end detecting means 60 outputs the end-of-game signal, then the continuous play controlling means 58 judges that the player cannot keep the continuous play, and this controlling means 58 outputs a non-continuous play signal to the pivotal angle controlling means 64 and the playable game computing means 66. If the insertion detecting means 56 outputs the coin insertion signal within 9 seconds from the time when the game end detecting means 60 outputs the end-of-game signal, then the play controlling means 58 judges that the player can keep the continuous play, and this controlling means 58 outputs a continuous play signal to the acquisition detecting means 62 and the playable game computing means 66. If the game end detecting means 60 outputs the end-of-game signal, with the non-continuous play signal output from the play controlling means 58 when a coin is inserted in the coin slot 18 for the last time, the play controlling means 58 controls the continuous playability indicating means 50 in such a manner that this indicating means 50 may indicate that the player can keep the continuous play for 9 seconds after the game end detecting means 60 outputs the end-of-game signal.

If the continuous play controlling means 58 outputs the non-continuous play signal, the pivotal angle controlling means 64 sets the closing pivotal angle of the claws 12*a* and 12*b* at the third angle. If the play controlling means 58 outputs the continuous play signal, the acquisition detecting means 62 outputs either an acquisition success signal or an acquisition failure signal to the angle controlling means 64, depending on whether there was an acquisition in the last game. If the acquisition detecting means 62 outputs the acquisition success signal, the angle controlling means 64 makes the closing pivotal angle of the claws 12*a* and 12*b* smaller than in the last game. However, if the closing pivotal angle in the last game is the first angle, the closing pivotal angle of the claws 12*a* and 12*b* is made the first angle even though the acquisition success signal is output. If the acquisition detecting means 62 outputs the acquisition failure signal, the angle controlling means 64 makes the closing pivotal angle of the claws 12*a* and 12*b* larger than in the last game. However, if the closing pivotal angle in the last game is the fifth angle, the closing pivotal angle of the claws 12*a* and 12*b* is made the fifth angle even though the acquisition failure signal is output. Then, the angle controlling means 64 controls the closing pivotal angle indicating means 52 in such a manner that this indicating means 52 may display the closing pivotal angle of the claws 12*a* and 12*b*.

If the continuous play controlling means 58 outputs the non-continuous play signal, the playable game computing means 66 sets the number of playable games at 1. If the play controlling means 58 outputs the continuous play signal, the game computing means 66 computes the number of playable games by adding 1 to the number of games playable when a coin was inserted in the coin slot 18 for the last time. However, if the number of playable games reaches 3, the game computing means 66 does not add 1. If the game end detecting means 60 outputs the end-of-game signal, with the continuous play signal output from the play controlling means 58 when a coin was inserted for the last time, the game computing means 66 computes the number of playable games by subtracting 1 from the number of playable games for the last time. Then, the game computing means 66 outputs the computed number of playable games to the playable game indicating means 54, which then displays this number.

If the playable game computing means 66 computes the number of playable games at 1 or more, the continuous game end judging means 68 judges that the continuous game has not ended, and this judging means 68 outputs a continuous game continuation signal to the acquisition detecting means 62. If the end judging means 68 outputs the continuous game continuation signal, the acquisition detecting means 62 outputs either the acquisition success signal or the acquisition failure signal to the closing pivotal angle controlling means 64, depending on whether there was an acquisition in the last game. If the game computing means 66 computes the number of playable games at 0, the end judging means 68 judges that the continuous game has ended, and this judging means 68 controls the continuous playability indicating means 50 in such a manner that this indicating means 50 may indicate that the player can keep the continuous play for 9 seconds after the game end detecting means 60 outputs the end-of-game signal.

Figure 6:
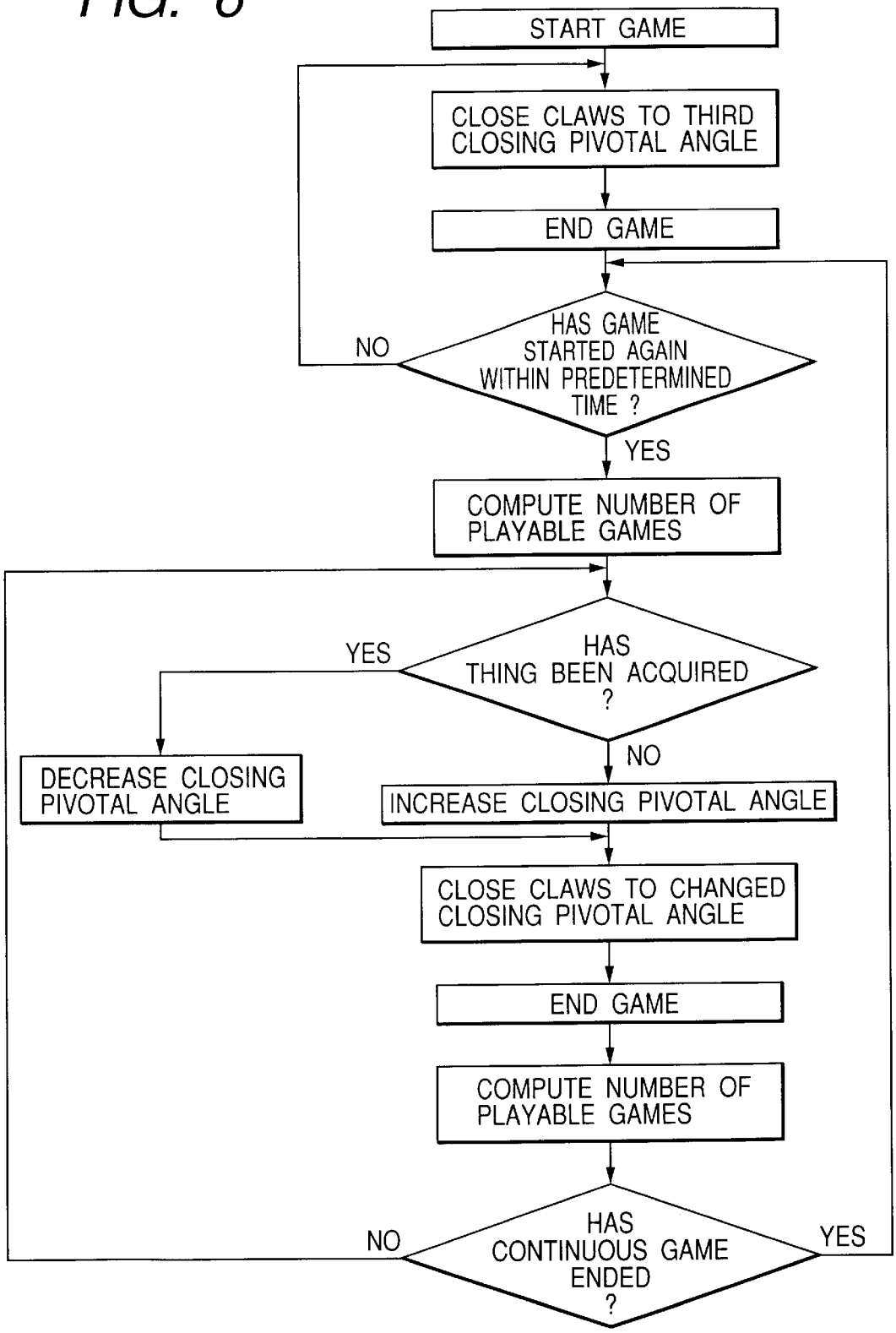
FIG. 6 is a flow chart of the operation of the game machine shown in FIGS. 1–5.

With reference to FIG. 6, the operation of the game machine shown in FIGS. 1–5 is described below. If a player inserts a coin in the coin slot 18 after 9 seconds from the time when the game end detecting means 60 outputs the end-of-game signal, the insertion detecting means 56 outputs the coin insertion signal to the continuous play controlling means 58, which then outputs the non-continuous play signal. Then, the playable game computing means 66 computes the number of playable games at 1, and the playable game indicating means 54 indicates that the number of playable games is 1. In the meantime, the closing pivotal angle controlling means 64 sets the closing pivotal angle of the claws 12*a* and 12*b* at the third angle, and the closing pivotal angle indicating means 52 indicates that the closing pivotal angle is the third angle. At the same time, the lamp in the right-and-left operating button 26 lights up, prompting the player to push this button 26. Then, while the player is pressing the button 26, the right-and-left moving member 4 moves in the direction A. When the player stops pressing the button 26, the moving member 4 stops, and the lamp in the back-and-forth operating button 28 lights up, prompting him or her to press this button 28. Then, while the player is pressing the button 28, the back-and-forth moving member 6 moves in the direction C. When the player stops pressing the button 28, the moving member 6 stops, and the telescopic rod 8 extends by a predetermined length. Then, the synchronous motor 42 operates to make the claws 12*a* and 12*b* pivot to their closed positions. In this case, the closing pivotal angle controlling means 64 sets the driving time of the motor 42 at 4 seconds so that the closing pivotal angle of the claws 12*a* and 12*b* may be the third angle.

With the claws 12*a* and 12*b* closed, the telescopic rod 8 retracts to its home position, and the moving members 4 and 6 move in the directions A and D respectively until the holder body 10 and the claws 12*a* and 12*b* are positioned over the drop corner 14. The synchronous motor 42 operates to open the claws 12*a* and 12*b* over the drop corner 14. The right-and-left moving member 4 moves in the direction B to return the holder body 10 and the open claws 12*a* and 12*b* to their home position. If the claws 12*a* and 12*b* are positioned over the drop corner 14 hold a thing, the thing drops onto the corner 14 when the claws 12*a* and 12*b* open. A conveyor (not shown) conveys the thing from the drop corner 14 into the outlet port 34, out of which the player can take the thing. If the claws 12*a* and 12*b* are positioned over the drop corner 14 hold nothing, nothing drops onto the corner 14 when the claws 12*a* and 12*b* open. In this case, the player can acquire nothing. When the claws 12*a* and 12*b* return to their home position, the game ends. Then, the game end detecting means 60 outputs the end-of-game signal to the continuous play controlling means 58, which then controls the continuous playability indicating means 50 in such a manner that this indicating means 50 may indicate that the player can keep the continuous play for 9 seconds after the game ends.

Then, if a coin is inserted in the coin slot 18 within 9 seconds after the game end, the continuous play controlling means 58 outputs the continuous play signal. In accordance with this signal, the playable game computing means 66 computes the number of playable games at 2 by adding 1 to the number (1) of games playable when a coin was inserted for the last time. This causes the playable game indicating means 54 to indicate that the number of playable games is 2. In this case, if the player has acquired nothing in the last game, the acquisition detecting means 62 outputs the acquisition failure signal. In accordance with this signal, the closing pivotal angle controlling means 64 sets the closing pivotal angle of the claws 12*a* and 12*b* at the fourth angle. Then, the closing pivotal angle indicating means 52 indicates that the closing pivotal angle is the fourth angle. Subsequently, when the player pushes the operating buttons 26 and 28, the claws 12*a* and 12*b* move. Then, the telescopic rod 8 extends, and the output shaft of the synchronous motor 42 turns to close the claws 12*a* and 12*b*. In this case, the angle controlling means 64 sets the driving time of the motor 42 at 4.5 seconds so that the closing pivotal angle of the claws 12*a* and 12*b* may be the fourth angle. Thereafter, the rod 8 retracts, and the closed claws 12*a* and 12*b* move to their position over the drop corner 14, where they then open. When the open claws 12*a* and 12*b* return to their home position, the game ends. Then, the game end detecting means 60 outputs the end-of-game signal. In accordance with this signal, the playable game computing means 66 computes the number of playable games at 1 by subtracting 1 from the number (2) of playable games for the last time. Then, the playable game indicating means 54 indicates that the number of playable games is 1. In accordance with the end-of-game signal, the game end judging means 68 outputs the continuous game continuation signal to the acquisition detecting means 62 by judging that the continuous game has not ended.

In this case, if the player has acquired nothing in the last game, the acquisition detecting means 62 outputs the acquisition failure signal. In accordance with this signal, the closing pivotal angle controlling means 64 sets the closing pivotal angle of the claws 12*a* and 12*b* at the fifth angle. Then, the closing pivotal angle indicating means 52 indicates that the closing pivotal angle is the fifth angle. Subsequently, when the player pushes the operating buttons 26 and 28, the claws 12*a* and 12*b* move. Then, the telescopic rod 8 extends, and the output shaft of the synchronous motor 42 turns to close the claws 12*a* and 12*b*. In this case, the angle controlling means 64 sets the driving time of the motor 42 at 5 seconds so that the closing pivotal angle of the claws 12*a* and 12*b* may be the fifth angle. Thereafter, the rod 8 retracts, and the closed claws 12*a* and 12*b* move to their position over the drop corner 14, where they then open. When the open claws 12*a* and 12*b* return to their home position, the game ends. Then, the game end detecting means 60 outputs the end-of-game signal. In accordance with this signal, the playable game computing means 66 computes the number of playable games at 0 by subtracting 1 from the number (1) of playable games for the last time. Then, the continuous game end judging means 68 judges that the continuous game has ended, and this judging means 68 controls the continuous playability indicating means 50 in such a manner that this indicating means 50 indicates that the player can keep the continuous play for 9 seconds after the game end.

Then, if a coin is inserted in the coin slot 18 within 9 seconds after the game end, the continuous play controlling means 58 outputs the continuous play signal. In accordance with this signal, the playable game computing means 66 computes the number of playable games at 3 by adding 1 to the number (2) of games playable when a coin was inserted for the last time. Then, the playable game indicating means 54 indicates that the number of playable games is 3. In accordance with the continuous play signal, the closing pivotal angle controlling means 64 sets the closing pivotal angle of the claws 12*a* and 12*b* depending on whether there was an acquisition in the last game.

There may be a case where the player acquired a thing in the last game, with the closing pivotal angle being the third angle. In this case, if the continuous play controlling means 58 outputs the continuous play signal, or if the continuous game end judging means 68 outputs the continuous game continuation signal, the acquisition detecting means 62 outputs the acquisition success signal. In accordance with this signal, the closing pivotal angle controlling means 64 sets the closing pivotal angle of the claws 12*a* and 12*b* at the second angle. Then, the closing pivotal angle indicating means 52 indicates that the closing pivotal angle is the second angle. Subsequently, when the player pushes the operating buttons 26 and 28, the claws 12*a* and 12*b* move. Then, the telescopic rod 8 extends, and the output shaft of the synchronous motor 42 turns to close the claws 12*a* and 12*b*. In this case, the angle controlling means 64 sets the driving time of the motor 42 at 3.5 seconds so that the closing pivotal angle of the claws 12*a* and 12*b* may be the second angle.

Thus, if the player acquires nothing while he or she keeps the continuous play, i.e., after he or she starts a game again within 9 seconds after the end of the last game, the closing pivotal angle of the claws 12*a* and 12*b* is increased. If the player acquires a thing during his or her continuous play, the closing pivotal angle is decreased. If a coin is inserted in the coin slot 18 within 9 seconds after the game end, the continuous play controlling means 58 judges that the player keeps the continuous play. Every time this play controlling means 58 judges that the player keeps the continuous play, it increases the number of playable games by 1. However, if the number of playable games is 3, the play controlling means 58 does not increment it.

While the player keeps the continuous play, the closing pivotal angle of the claws 12*a* and 12*b* changes depending on whether he or she has acquired a thing. If the player has acquired nothing in the last game, the pivotal angle increases so that he or she can more easily acquire a thing. If the player has acquired a thing in the last game, the pivotal angle decreases so that it may be more difficult for him or her to acquire a thing. If the player keeps the continuous play, the number of playable games increases. This enables the player to play more games at the same charge. The closing pivotal angle indicating means 52 of the console 16 enables the player to know the closing pivotal angle of the claws 12*a* and 12*b*. Considering this pivotal angle, the player can push the operating buttons 26 and 28. This makes it easier for the player to acquire a thing.

Figure 7:
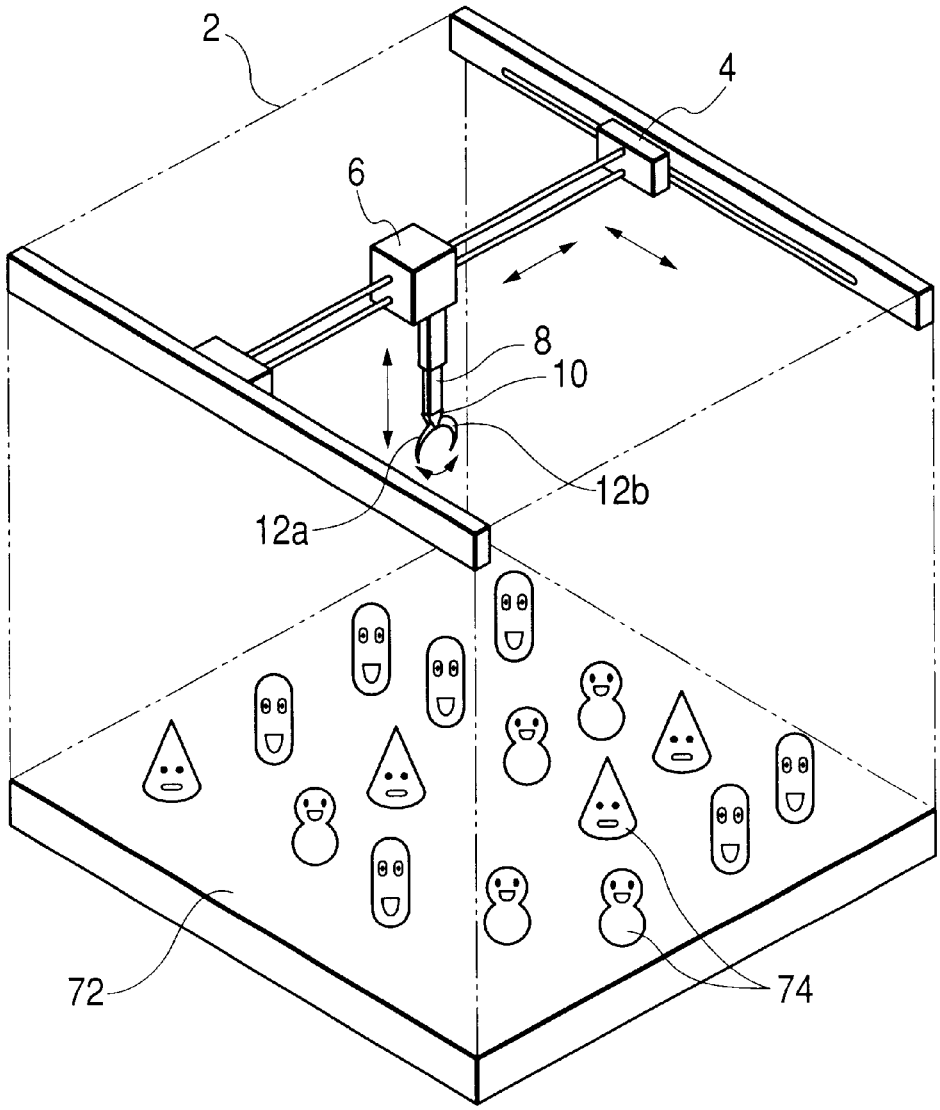
FIG. 7 is a perspective view of part of a game machine to which the present invention can be applied.

FIG. 7 shows a game machine to which the present invention can be applied. This game machine includes a main body 2 having a floor 72, on which a number of toys or other things 74 are placed.

Figure 8:
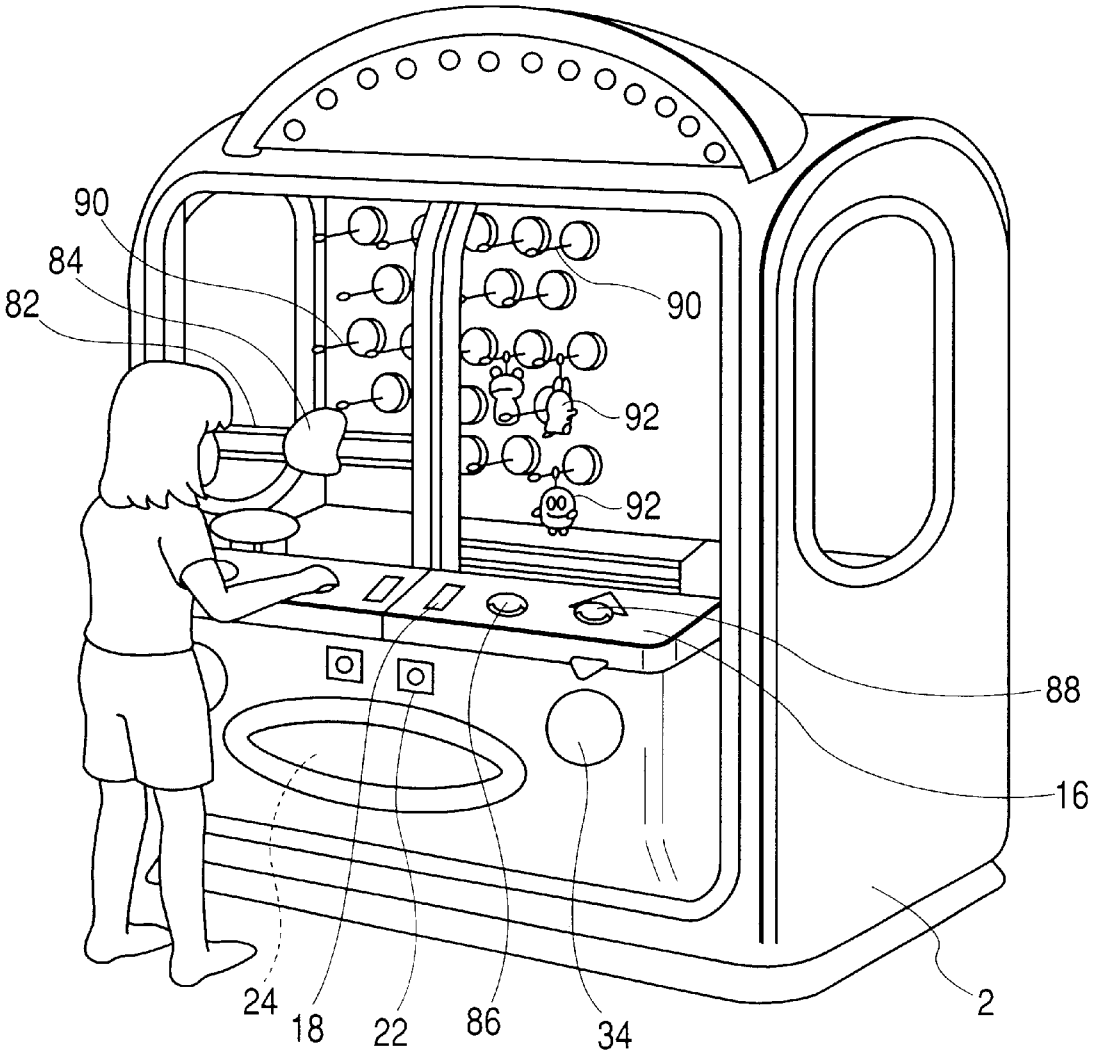
FIG. 8 is another perspective view of part of a game machine to which the present invention can be applied.

FIG. 8 shows another game machine to which the present invention can be applied. This game machine includes a main body 2. A vertical moving member 82 is supported by the body 2 movably in vertical direction. A horizontal moving member 84 is supported by the vertical moving member 82 movably in horizontal direction. The horizontal moving member 84 carries a telescopic rod (not shown), which carries a holder body (not shown) on its free end. A pair of claws (not shown) is supported pivotably by the holder body. The game machine also includes a console 16, which has a vertical operating button 86 and a horizontal operating button 88. The game machine further includes controlling means (not shown) for controlling the drives (not shown) for the moving members 82 and 84 in accordance with the operation of the operating buttons 86 and 88 respectively. The main body 2 is fitted with a number of horizontal holding members 90 in the form of bars, which hold key holders 92.

If a player inserts a coin in the coin slot 18 of this game machine, the lamp in the vertical operating button 86 lights up, prompting him or her to push this button 86. Then, while the player is pressing the button 86, the vertical moving member 82 vertically moves. When the player stops pressing the button 86, the moving member 82 stops, and the lamp in the horizontal operating button 88 lights up, prompting him or her to press this button 88. Then, while the player is pressing the button 88, the horizontal moving member 84 horizontally moves. When the player stops pressing the button 88, the moving member 84 stops, and the telescopic rod extends by a predetermined length. Then, the synchronous motor (not shown) of this game machine operates to make the claws pivot to their closed positions. Then, the telescopic rod retracts to its home position, and the moving members 82 and 84 move until the holder body and the claws are positioned over the drop corner in the main body 2. The synchronous motor operates to open the claws over the drop corner. The vertical moving member 82 moves to return the holder body and the open claws to their home position. Then, the game ends.

Figure 9:
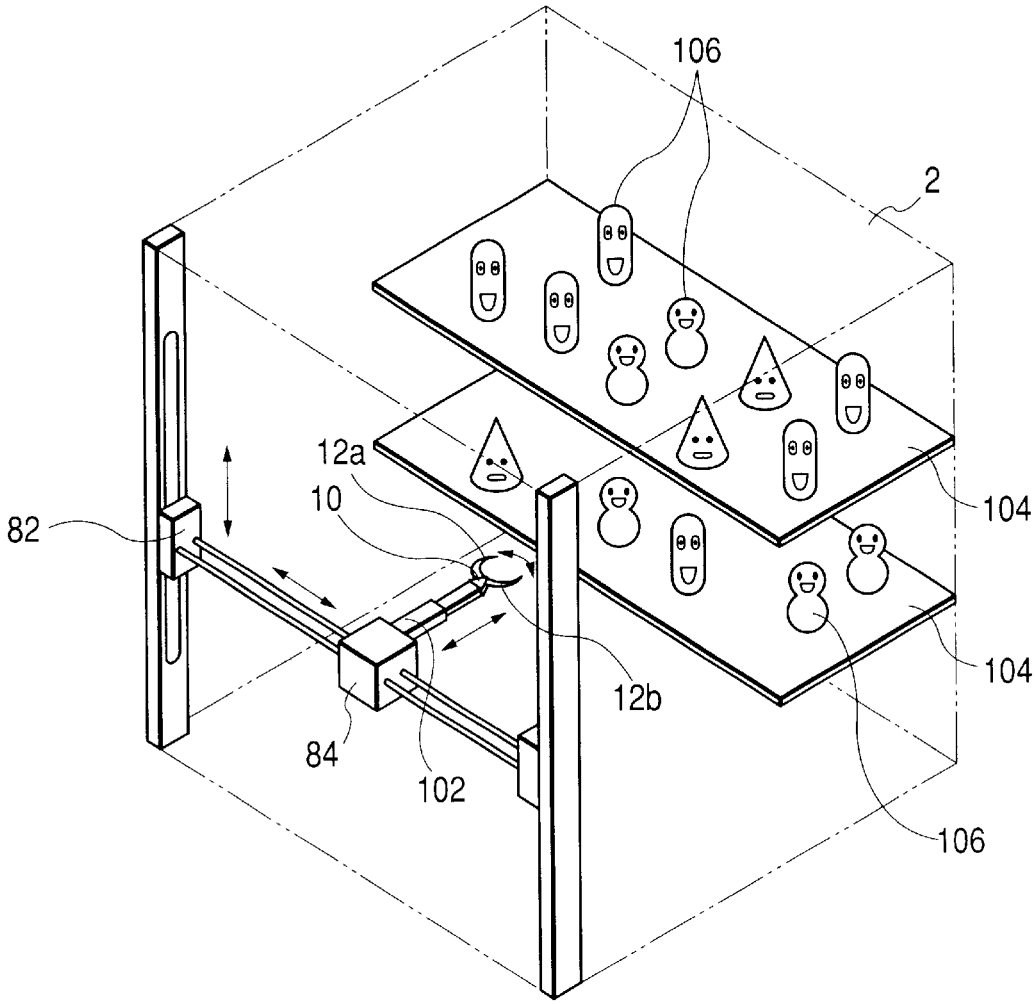
FIG. 9 is still another perspective view of part of a game machine to which the present invention can be applied.

FIG. 9 shows still another game machine to which the present invention can be applied. This game machine includes a main body 2. A vertical moving member 82 is supported by the body 2 movably in vertical direction. A horizontal moving member 84 is supported by the vertical moving member 82 movably in horizontal direction. The horizontal moving member 84 carries a telescopic rod 102, which carries a holder body 10 on its free end. A pair of claws 12*a* and 12*b* is supported pivotably by the holder body 10. The main body 2 is fitted with two horizontal plates 104 in it, on which a number of toys or other things 106 are placed.

Figure 10:
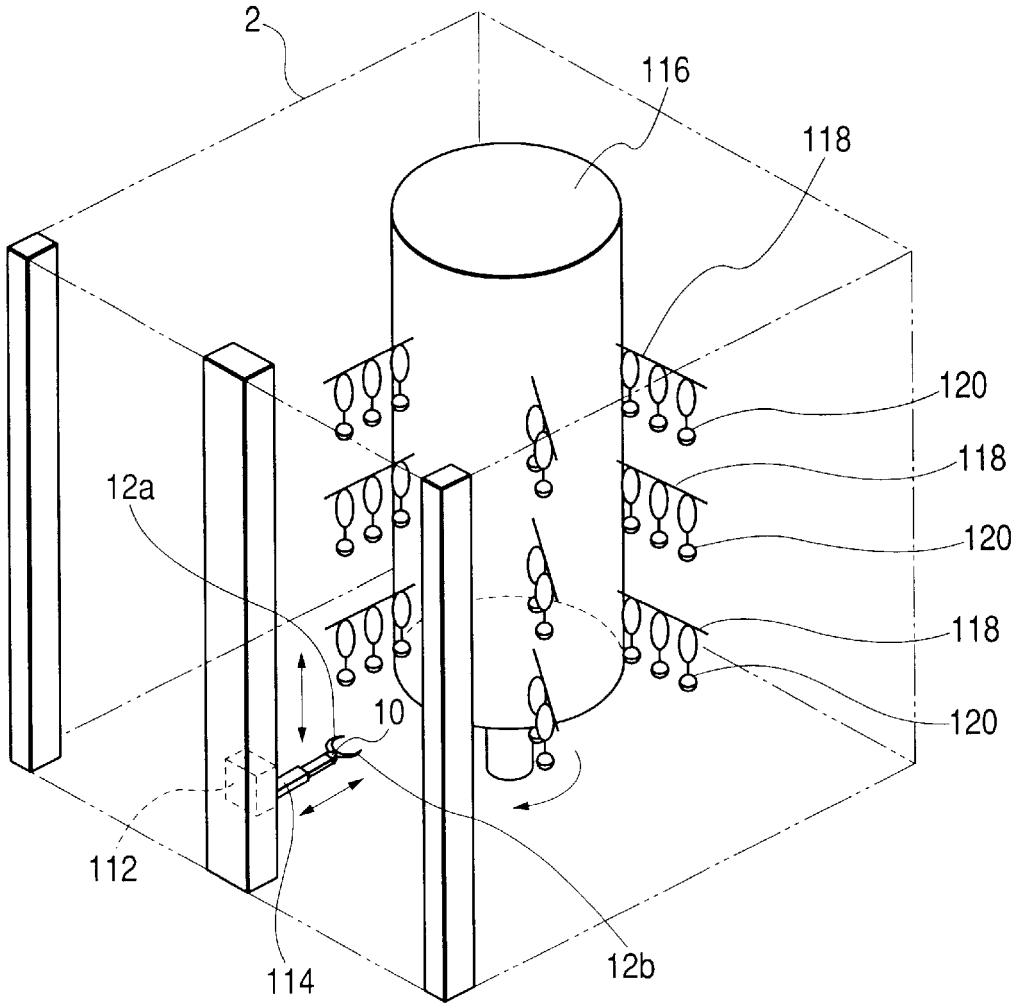
FIG. 10 is yet another perspective view of part of a game machine to which the present invention can be applied.

FIG. 10 shows yet another game machine to which the present invention can be applied. This game machine includes a main body 2. A vertical moving member 112 is supported by the body 2 movably in vertical direction. The moving member 112 carries a telescopic rod 114, which carries a holder body 10 on its free end. A pair of claws 12*a* and 12*b* is supported pivotably by the holder body 10. A rotor 116 is supported in the main body 2 and can be rotated on a vertical axis by a motor (not shown). The rotor 116 is fitted with a number of horizontal holding members 118 in the form of bars on its cylindrical wall. The holding members 118 hold key holders or other things 120. The game machine also includes a console (not shown), which has a vertical operating button and a rotational operating button. The game machine further includes controlling means (not shown) for controlling the drives (not shown) for the moving member 112 and the rotor 116 in accordance with the operation of the operating buttons.

If a player inserts a coin in the coin slot of this game machine, the lamp in the vertical operating button lights up, prompting him or her to push this button. Then, while the player is pressing the vertical operating button, the vertical moving member 112 vertically moves. When the player stops pressing the vertical operating button, the moving member 112 stops, and the lamp in the rotational operating button lights up, prompting him or her to press this button. Then, while the player is pressing the rotational operating button, the rotor 116 rotates. When the player stops pressing the rotational operating button, the rotor 116 stops, and the telescopic rod 114 extends by a predetermined length. Then, the synchronous motor (not shown) of this game machine operates to make the claws 12*a* and 12*b* pivot to their closed positions. Then, the telescopic rod 114 retracts to its home position. Then, the synchronous motor operates to open the claws 12*a* and 12*b*. Then, the vertical moving member 112 moves to return the holder body 10 and the open claws 12*a* and 12*b* to their home position. Then, the game ends.

In each of the embodiments, the synchronous motor 42 is used to drive the claws 12*a* and 12*b*. It is possible to control the closing pivotal angle of the claws 12*a* and 12*b* by controlling the driving time of the motor 42. Alternatively, the claws 12*a* and 12*b* could be driven by a stepping motor. It is possible to control the closing pivotal angle of the claws 12*a* and 12*b* by controlling the number of driving pulses of the stepping motor. Alternatively, the claws 12*a* and 12*b* could be driven by a DC motor with a pulse encoder or another rotational angle sensor. It is possible to control the closing pivotal angle of the claws 12*a* and 12*b* by controlling the number of feedback pulses of the pulse encoder.

In each of the embodiments, the coin insertion detecting means 56 is used to detect the start of a game. Alternatively, the start of a game could be detected by a paper money detecting means or an information reading means for reading information from a magnetic card, which is a plastic card with information recorded magnetically on it.

In each of the embodiments, if the player has acquired nothing in the last game, the closing pivotal angle of the claws 12*a* and 12*b* is increased. On the contrary, if the player has acquired a thing in the last game, the closing pivotal angle is decreased. Alternatively, if the player had acquired a thing in the last game, the closing pivotal angle could be constant.

In each of the embodiments, if the coin insertion detecting means 56 outputs a coin insertion signal within 9 seconds after the time when the game end detecting means 60 outputs an end-of-game signal, then the continuous play controlling means 58 outputs a continuous play signal by judging that the player keeps the continuous play. That is to say, the continuous play judging time is 9 seconds. In the present invention, however, the continuous play judging time is not limited to 9 seconds, but may depend on how to play with a specific game machine, or may be changed suitably by the game center or the person who has installed the machine.

In each of the embodiments, the continuous playability indicating means 50 indicates that the player can keep the continuous play for 9 seconds after the end of a game. This indicating means 50 might comprise a 7-segment LED to indicate how many seconds a coin needs to be inserted within in the coin slot 18 for continuous play. Specifically, the 7-segment LED may indicate the number of seconds like "9", "8", . . . every second.

In each of the embodiments, the 5 closing pivotal angles are set in the closing pivotal angle controlling means 64, but 2 or more closing pivotal angles might be set in it. The 5 closing pivotal angles are set in advance in the controlling means 64. The controlling means 64 might be replaced with a closing pivotal angle controlling means that makes it possible to arbitrarily set the closing pivotal angle of the claws 12*a* and 12*b*.

In each of the embodiments, if the continuous play controlling means 58 outputs a non-continuous play signal, the playable game computing means 66 computes the number of playable games at 1, but might compute it at 2 or more. This computing means 66 might be replaced by a playable game computing means that can arbitrarily set the number of games that can be played when the continuous play controlling means 58 outputs a non-continuous play signal.

In each of the embodiments, the closing pivotal angle indicating means 52 is fitted at the top of the console 16 so that the player can know the closing pivotal angle of the claws 12*a* and 12*b*. Alternatively, an angle indicating means might be fitted in the main body 2 so that the player cannot know the angle. An angle indicating means could also function as a playable game indicating means to indicate the closing pivotal angle and the number of playable games alternately every two seconds, for example.

In each of the embodiments, one game can be played at one coin. In the present invention, however, one game may be played at two coins with a specific game machine. Otherwise, the person who has installed the game machine may suitably set different play charges.

The foregoing invention has been described in terms of preferred embodiments. However, those skilled, in the art will recognize that many variations of such embodiments exist. Such variations are intended to be within the scope of the present invention and the appended claims.

What is claimed is:

1. A game machine comprising:

a) a main body;

b) a first moving member supported movably by said main body;

c) an operating button for operating said first moving member;

d) pivotable claws carried by said first moving member;

e) an acquisition detecting means for detecting a thing acquired in the last game; and f) a closing pivotal angle controlling means for controlling the closing pivotal angle of said claws in accordance with the output from said acquisition detecting means.

2. The game machine according to claim 1, wherein a second moving member is supported movably by said first moving member, and said claws are carried by said second moving member.

3. The game machine according to claim 2, wherein said first moving member and said second moving member are a right-and-left moving member and a back-and-forth moving member.

4. The game machine according to claim 2, wherein said first moving member and said second moving member are a vertical moving member and a horizontal moving member.

5. The game machine according to claim 4, wherein horizontal holding members in the form of bars are fitted to said main body.

6. The game machine according to claim 1, wherein said first moving member is a vertical moving member, a rotor is supported by said main body rotatably on a vertical axis, and horizontal holding members in the form of bars are fitted to said rotor.

7. The game machine according to claim 1, wherein a telescopic rod is carried by said first moving member, a holder body is fitted to the free end of said rod, and said claws is supported by said holder body.

8. The game machine according to claim 1, wherein said claws are driven by a synchronous motor.

9. The game machine according to claim 1, wherein said claws are driven by a stepping motor.

10. The game machine according to claim 1, wherein said claws are driven by a DC motor including a rotational angle sensor.

11. The game machine according to claim 1, further comprising a closing pivotal angle indicating means for indicating said closing pivotal angle.

12. The game machine according to claim 1, further comprising a game end detecting means for detecting the end of a game, a game start detecting means for detecting the start of a game, a continuous play controlling means for judging from the output from said game end detecting means and the output from said game start detecting means whether a player keeps a continuous play, and a playable game computing means for incrementing the number of playable games if said continuous play controlling means judges that the player keeps said continuous play.

13. The game machine according to claim 12, wherein said game start detecting means is a coin insertion detecting means.

14. The game machine according to claim 12, further comprising a continuous game end judging means for judging that a continuous game ends if said playable game computing means computes the number of playable games at 0, and a continuous playability indicating means for indicating that the player can keep said continuous play for a predetermined time after said game end detecting means outputs an end-of-game signal if said continuous game end judging means judges that the continuous game ends.

15. The game machine according to claim 12, further comprising a playable game indicating means for indicating the number of playable games computed by said playable game computing means.

* * * * *